US005890389A

United States Patent [19]

Ohba et al.

[11] Patent Number: 5,890,389

[45] Date of Patent: Apr. 6, 1999

[54] METHOD OF MANUFACTURING MODIFIED CROSS-SECTION MATERIAL

[75] Inventors: Makoto Ohba; Noboru Hagiwara, both of Ibaraki; Kenji Yokomizo, Tokyo; Tadao Otani, Ibaraki, all of Japan

[73] Assignee: Hitachi Cable, Ltd., Tokyo, Japan

[21] Appl. No.: 962,044

[22] Filed: Oct. 31, 1997

[30] Foreign Application Priority Data

Oct. 31, 1996 [JP] Japan ..... 8-289929
Aug. 27, 1997 [JP] Japan ..... 9-231338

[51] Int. Cl.[6] ..... B21B 13/08

[52] U.S. Cl. ..... 72/234; 72/252.5; 72/366.2

[58] Field of Search ..... 72/181, 226, 234, 72/252.5, 365.2, 366.2

[56] References Cited

U.S. PATENT DOCUMENTS 4,279,139 7/1981 Schmitz ..... 72/234
4,578,979 4/1986 Abe et al. ..... 72/252.5
4,821,550 4/1989 DeBarea, Sr. ..... 72/181
4,969,346 11/1990 Bosl et al. ..... 72/181
5,761,946 6/1998 Misera et al. ..... 72/181

FOREIGN PATENT DOCUMENTS 58-159901 9/1983 Japan ..... 72/252.5
59-78701 5/1984 Japan .
61-50064 11/1986 Japan .
1-133603 5/1989 Japan .
3-18442 1/1991 Japan ..... 72/252.5
4-251626 9/1992 Japan ..... 72/252.5

*Primary Examiner*—Joseph J. Hail, III
*Assistant Examiner*—Ed Tolan
*Attorney, Agent, or Firm*—McDermott, Will & Emery

[57] ABSTRACT

A modified cross-section material having a thin part and a thick part in its widthwise direction is manufactured through a plurality of roll stages. Each rolling stage comprises of a set of a convex roll and a flat roll, wherein the convex roll has a convex part. The thin part is formed in accordance with the lengthwise expansion by the convex part of the convex roll, and the thick part is formed in accordance with the lengthwise expansion by a part other than the convex part of the convex roll.

11 Claims, 6 Drawing Sheets

9 MATERIAL
16A ROOT WIDTH
10A ROLL SET
12A TIP WIDTH
10B ROLL SET
16B ROOT WIDTH
12B TIP WIDTH
10C ROLL SET
16C ROOT WIDTH
12C TIP WIDTH
9c THIRD MODIFIED CROSS-SECTION MATERIAL
9 MATERIAL
9a FIRST MODIFIED CROSS-SECTION MATERIAL
11A ROLL CONVEX PART
11B ROLL CONVEX PART
9b SECOND MODIFIED CROSS-SECTION MATERIAL
11C ROLL CONVEX PART
9c THIRD MODIFIED CROSS-SECTION MATERIAL

FIG. 6

| ROLL | FIRST | SECOND | THIRD | FORTH |
|---|---|---|---|---|
| GROOVE WIDTH (mm) | 34.5 | 32.3 | 30.5 | 29.5 |
| GROOVE DEPTH (mm) | 2.07 | 1.89 | 1.67 | 1.56 |
| SLANT ANGLE OF GROOVE (°) | 35 | 45 | 55 | 65 |
| TIP WIDTH OF CONVEX PART (mm) | 11.0 | 17.0 | 21.0 | ∞ |
| SLANT ANGLE OF CONVEX PART (°) | 25 | 25 | 15 | 0 |

METHOD OF MANUFACTURING MODIFIED CROSS-SECTION MATERIAL

FIELD OF THE INVENTION

The invention relates to a method of manufacturing a modified cross-section material, and more particularly to, a method of manufacturing a material having a widthwise modified cross-section along its length.

BACKGROUND OF THE INVENTION

A material having a widthwise modified cross-section along its length is used for a transistor lead frame and a connector. As for a method of manufacturing the modified cross-section material, a cutting method, a machining method using a V-type dice and a roll, and a rolling method are known.

In a conventional method of manufacturing a modified cross-section material such as the rolling method, a material is inserted between a grooved roll having a groove in the center thereof and a flat roll. Then, the material is inserted between two flat rolls. Thus, modified cross-section material having two thin parts on the both sides thereof and a thick part in the center thereof is formed.

Next, the modified cross-section material is inserted between a grooved roll having a smaller groove than that of the prior grooved roll and a flat roll. Then, the material is inserted between two flat rolls. Thus, the modified cross-section material having wider thin parts than the prior thin parts is formed.

As the above, the modified cross-section material with a predetermined form is manufactured by the repetition of rolling with a grooved roll having a smaller groove than the prior and a flat roll.

In general, when the modified cross-section material is manufactured from a flat board material, there is a difference between an elongation of the center part and that of the side parts. A waveform and/or a torsion occur in the manufactured material by the difference between the elongations. As a solution of these, in the Japanese Patent Kokai No.59-78701, it is disclosed that the both side parts of the material are rolled, without rolling the center part of the material, by using the grooved roll and the flat roll, then, the modification of the both side parts occurs both in the groove of the grooved roll and between both sides of the grooved roll and the flat roll in the widthwise direction, thus, the elongations of the both side parts are balanced with the elongation of the center part.

Another method of manufacturing a modified cross-section material is disclosed in the Japanese Patent Kokai No.61-50064.In this conventional method of manufacturing a modified cross-section material, a material is inserted between a first convex roll having two convex parts and a flat roll. Then, the material is inserted between a second convex roll and a flat roll. One side face of the convex part is a slant face. The convex part of the first convex roll is smaller than that of the second convex roll. Namely, the convex part of a next convex roll is bigger than that of a prior convex roll.

As the above, the modified cross-section material with a predetermined form is manufactured by the repetition of rolling with a convex roll having two bigger convex parts than the prior convex parts and a flat roll.

A further conventional method of manufacturing a modified cross-section material is disclosed in the Japanese Patent Kokai No.1-133603. In this conventional method, the modified cross-section material is manufactured by the repetition of rolling with rolls based on a predetermined modification factor and annealing. Thus, the size accuracy of the modified cross-section material is improved.

Among the conventional methods of manufacturing a modified cross-section material, however, the cutting method has disadvantages in that the manufacturing cost is high, because a great loss of material is caused by cutting scraps. On the other hand, the machining method using a V-type dice and a roll has disadvantages in that the machining speed can not be high and it is difficult to improve in the productivity, because the machining process is to be interrupted due to the pressure caused by reciprocating motion of the rolls.

Further, the rolling method has disadvantages in that the rough surface is occurred in the thick part, because the thick part is not rolled in the groove of the grooved roll, and the quality of the manufactured material is to be poor due to the inequality of the thick part because the sides of the thick part are thicker than the center of that due to the inflow of material into the groove of the grooved roll.

Even further, the method in the Japanese Patent Kokai No.61-50064 has disadvantages in that the rough surface and the inequality of the thick part are occurred by the same reason as the above, and the width of the thin part which is formed by one rolling phase is smaller than that of the rolling method, because the modification of the material is occurred generally in only the both side parts (i.e. the thin parts).

Further, the methods in the Japanese Patent Kokai No.59-78701 and No.61-50064 have disadvantages in that the difference between the modification quantity of the rolled thin parts and the unrolled thick part is occurred along its length on the material, because it is difficult that the modification of the rolled part is perfectly occurred on the material in the widthwise direction, and though the difference between the modification quantities of the rolled thin parts and the unrolled thick part is different, according to the form of the roll and the modification extent, a waveform-deformation and/or a torsion occur in the manufactured material, when the difference is large.

Even further, the Japanese Patent Kokai No.1-133603 has disadvantages in that the operability and the productivity in manufacturing the modified cross-section material are poor, because the manufacturing process is not completed at one process (rolling phase).

SUMMARY OF THE INVENTION

Accordingly, it is an object of the invention to provide a method of manufacturing a modified cross-section material in which the operability and the productivity are to be good.

It is another object of the invention to provide a method of manufacturing a modified cross-section material in which the modified cross-section material is to be high in quality.

According to the feature of the invention, a method of manufacturing modified cross-section material having different board thicknesses along widthways, the different board thicknesses being formed successively along lengthways, the method comprising the steps of forming a roll set including a flat roll and a convex roll which has convex parts around, each of the convex parts having a slant face at no less than one side thereof, placing tandem a plurality of the roll sets, the tip width of the convex part of the next roll set is larger than that of the prior roll set, forming a thin part of the modified cross-section material by the convex part of the convex roll, and forming a thick part of the modified cross-section material by a different part from the convex part of the convex roll.

BRIEF DESCRIPTION OF THE DRAWINGS

The invention will be described in more detail in conjunction with the accompanying drawings, wherein:

FIG. 6 is a table showing the configuration of rolls used in the present invention.

DETAILED DESCRIPTION OF THE PREFERRED EMBODIMENTS

Before explaining a method of manufacturing a modified cross-section material in the preferred embodiment according to the invention, the above mentioned conventional method of manufacturing a modified cross-section material will be explained in FIGS. 1A to 1D and 2A and 2B.

In FIG. 1 A, a material 3 is inserted between a grooved roll 1A having a groove la in the center thereof and a flat roll 2A. When the grooved roll 1A and the flat roll 2A start rolling the material 3, two thin parts 3*b* are formed by the both sides 1*b* of the grooved roll 1A and a thick part 3*a* is formed by the groove 1*a*. Then, in FIG. 1B, the material 3 is inserted between two flat rolls 4A and 2B. Thus, the thick part 3*a* of the material 3 is flattened by the two flat rolls 4A and 2B, then, a halfly modified cross-section material 3' having the two thin parts 3*b* at the both sides thereof and a thick part 3*a* in the center thereof is formed.

Next, in FIG. 1 C, the modified cross-section material 3' is inserted between a grooved roll 1B having a smaller groove 1*a*'than that 1*a* of the prior grooved roll 1A and a flat roll 2C. Thus, the thin parts 3*b* are widened by the grooved roll 1B and the flat roll 2C. Then, in FIG. 1 D, the material is inserted between two flat rolls 4B and 2D. Thus, a modified cross-section material 5 having wider thin parts 3*b*' than the prior thin part 3*b* is formed.

As the above, the modified cross-section material 5 with a predetermined form is manufactured by the repetition (steps A to D) of rolling processes with a grooved roll having a smaller groove than the prior roll and a flat roll.

Figure 1A:
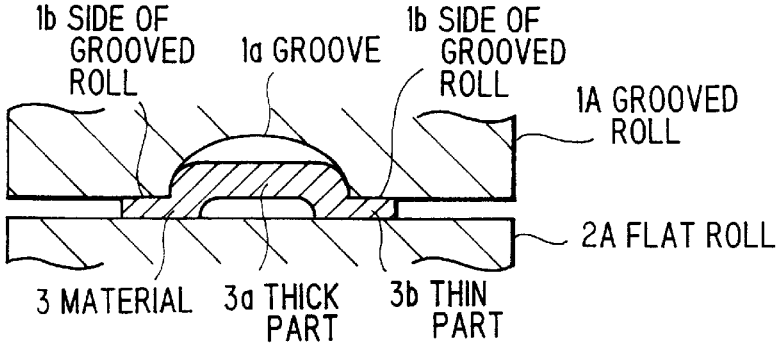
FIG. 1A PRIOR ART
FIGS. 1A to 1D are partly sectional fragmentary schematic views showing how a modified cross-section material is manufactured in a conventional rolling method.
Figure 1B:
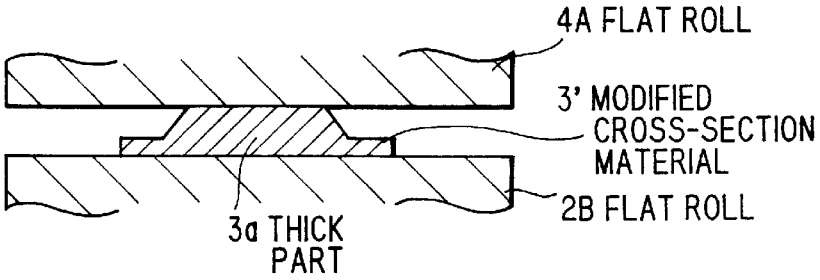
FIG. 1B PRIOR ART
Figure 1C:
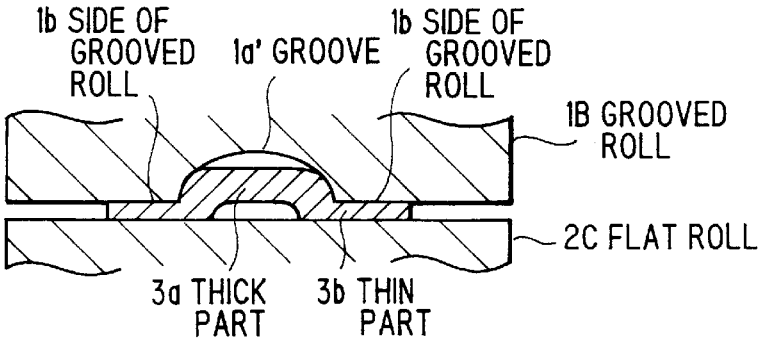
FIG. 1C PRIOR ART
Figure 1D:
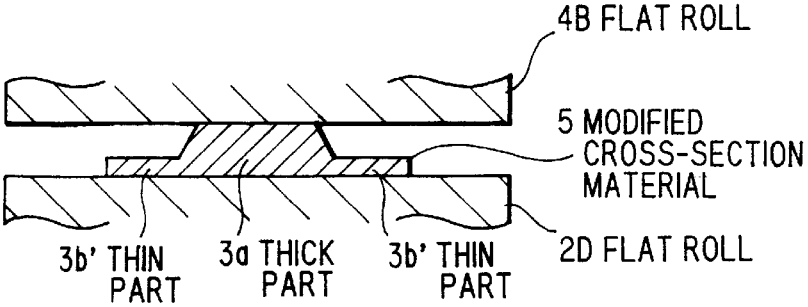
FIG. 1D PRIOR ART
Figure 2A:
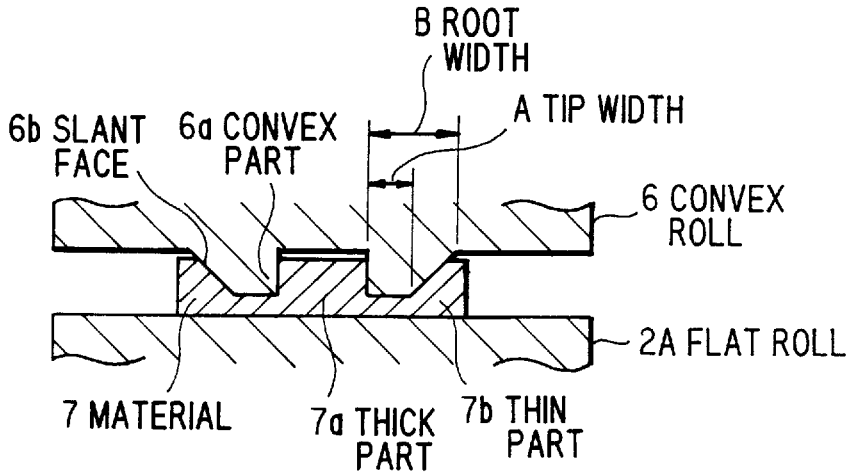
FIG. 2A PRIOR ART
FIGS. 2A and 2B are partly sectional fragmentary schematic views showing how a modified cross-section material is manufactured in another conventional rolling method.
Figure 2B:
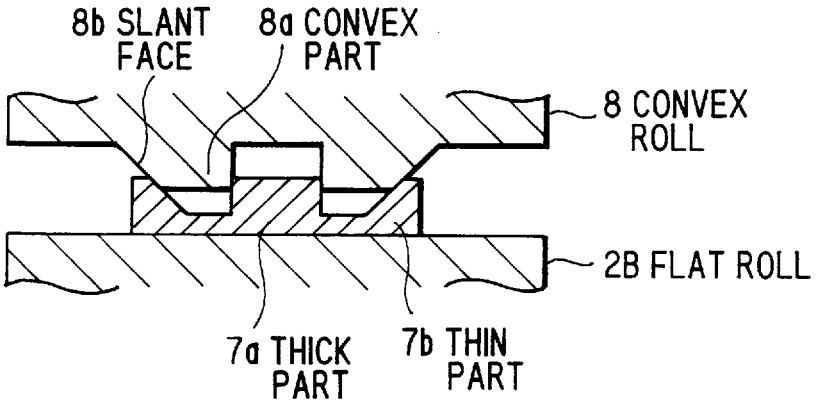
FIG. 2B PRIOR ART

FIGS. 2A and 2B show the conventional method of manufacturing a modified cross-section material which is disclosed in the Japanese Patent Kokai No.61-50064. In FIG. 2A, a material 7 is rolled between a first convex roll 6 having two convex parts 6*a*and a flat roll 2A. The convex part 6*a* has a slant face 6*b*. two convex parts 6*b* are designed to have a predetermined distance therebetween. Thus, the thin parts 7*b* are formed by the slant faces 6*b* of the convex parts 6*a*, while the thick part 7*a* having a width which is the same as the predetermined distance between the two convex parts 6*a* is formed. Next, in FIG. 2B, the material 7 is rolled between a second convex roll 8 and a flat roll 2B. The convex part 6*a* of the first convex roll 6 is smaller than the convex part 8*a* of the second convex roll 8. Namely, the convex part of a next convex roll is bigger than that of a prior convex roll. In this case, the tip of the convex part 8*a* is smaller than the root of the convex part 6*a*, and the root of the convex part 8*a* has a width smaller than twice the width of the root of the convex part 6*a*. Further, the height of the convex part 8*a* is greater than that of the convex part 6*a*, and the length of the slant face 8*b* is greater than that of the slant face 6*b*.

As the above, the modified cross-section material with a predetermined form is manufactured by the repetition of rolling process with a convex roll having two bigger convex parts than the prior convex parts and a flat roll.

In the above conventional method of manufacturing a modified cross-section material in FIGS. 1A to 1D, however, there are disadvantages in that the rough surface of the thick part 3*a* is occurred, because the thick part 3*a* is not rolled in the groove (1*a*, 1*a*') of the grooved roll (1A, 1B), and the quality of the manufactured material 5 is to be poor due to the inequality of the thick part 3*a*, because the sides of the thick part 3*a* are to be thicker than the center due to the inflow of material (3, 3') into the groove (1*a*, 1*a*') of the grooved roll (1A, 1B).

Further, in the above conventional method of manufacturing modified cross-section material in FIGS. 2A and 2B, however, there are disadvantages in that the rough surface and the inequality of the thick part 7*a* are occurred by the same reason as FIGS. 1A to 1D, and the width of the thin part 7*b* which is formed at one process is smaller than that of the method in FIGS. 1A to 1D, because the modification of the material 7 is generally occurred in only the both side parts 7*b* (i.e. the thin parts 7*b*).

Even further, in the above conventional methods in FIGS. 1A to 1D and FIGS. 2A and 2B, however, there are disadvantages in that the difference between the modification quantity of the rolled thin parts (3*b*, 3*b*', 7*b*) and the unrolled thick part (3*a*, 7*a*) is occurred on the material along its length (3; 3' 7), because it is difficult that the modification of the rolled part is perfectly occurred on the material (3, 3' 7) in the widthwise direction, and though the difference between the modification quantities of the rolled thin parts (3*b*, 3*b*', 7*b*) and the unrolled thickpart (3*a*, 7*a*) is different, according to the form of the roll and the modification extent, a waveform-deformation and/or a torsion occur in the manufactured material (5, 7), when the difference is large.

Next, a method of manufacturing a modified cross-section material in the first preferred embodiment according to the invention will be explained in FIGS. 3A to 3C and 4A to 4C.

Figures 3A, 3B, 3C:
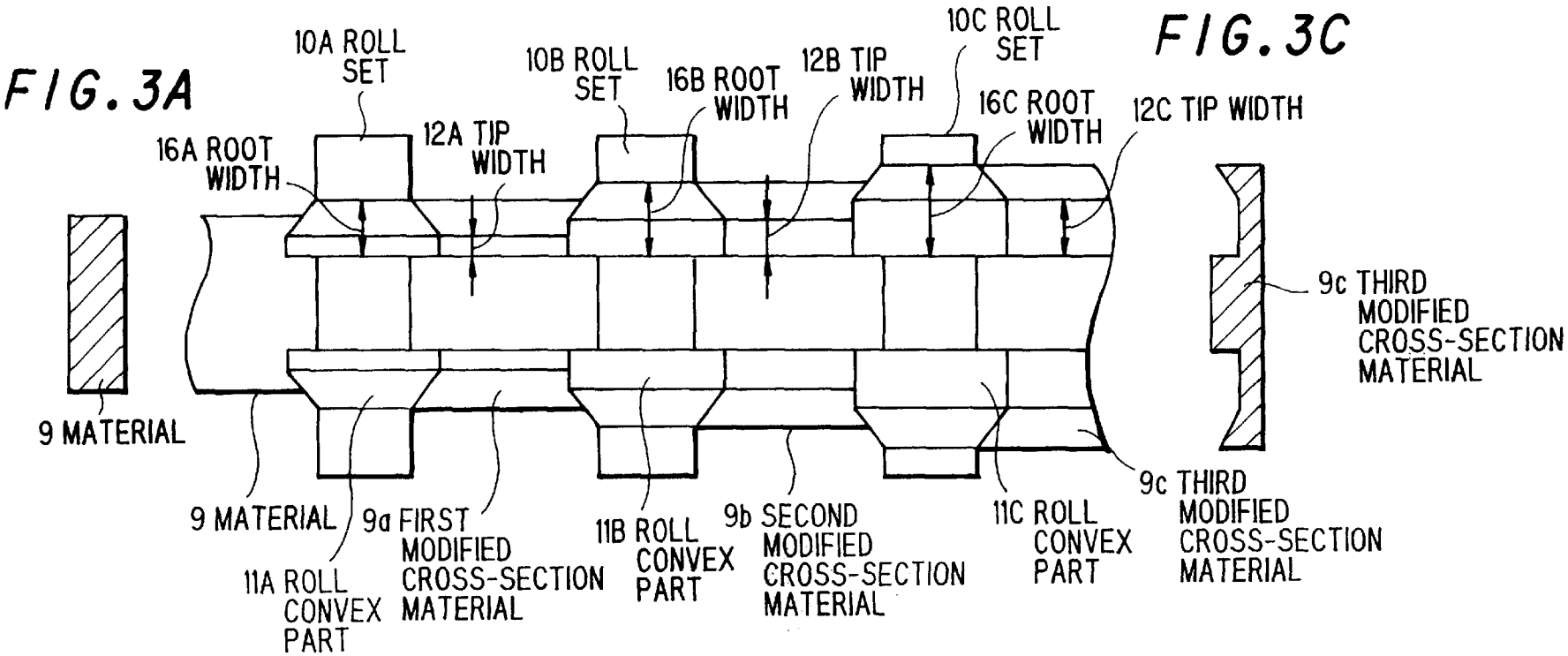
FIGS. 3A to 3C are block schematic diagrams showing an apparatus for manufacturing a modified cross-section material used in a method in a first preferred embodiment of the present invention.

FIG. 3A shows a flat material 9 before rolled, FIG. 3B shows an apparatus for manufacturing a modified cross-section material, and FIG. 3C shows a modified material 9*c* after rolled.

In FIG. 3B, the apparatus comprises roll sets 10A, 10B, 10C. Each of the roll sets 10A, 10B, 10C has a convex roll (a top roll) and a flat roll (an under roll). The roll sets 10A, 10B, 10C are placed parallel and tandem at a predetermined distance and at right-angle to the process direction of the material 9 (for example, copper, copper alloy, aluminum, aluminum alloy, iron, stainless steel, or composite material of these).

Figure 4A:
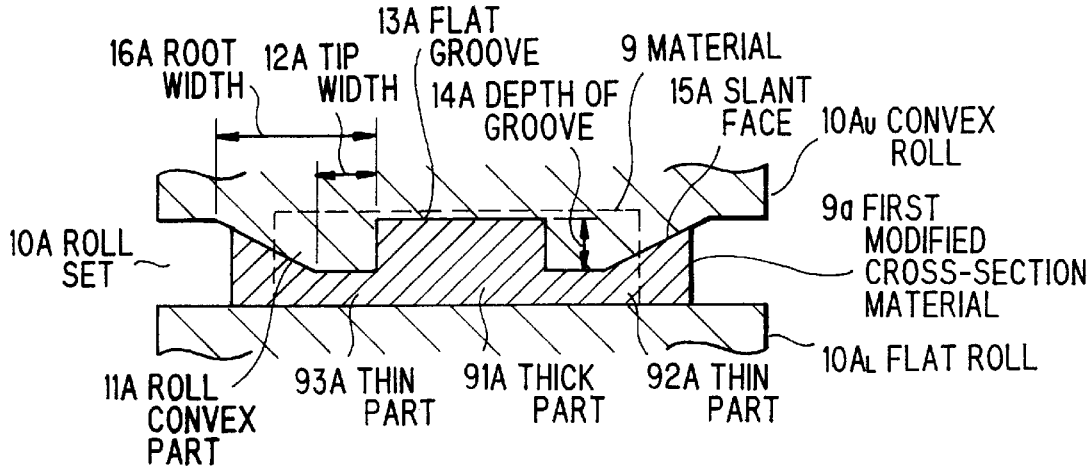
FIGS. 4A to 4C are partly sectional fragmentary schematic showing how a modified cross-section material is manufactured in the apparatus of FIGS. 3A to 3C.
Figure 4B:
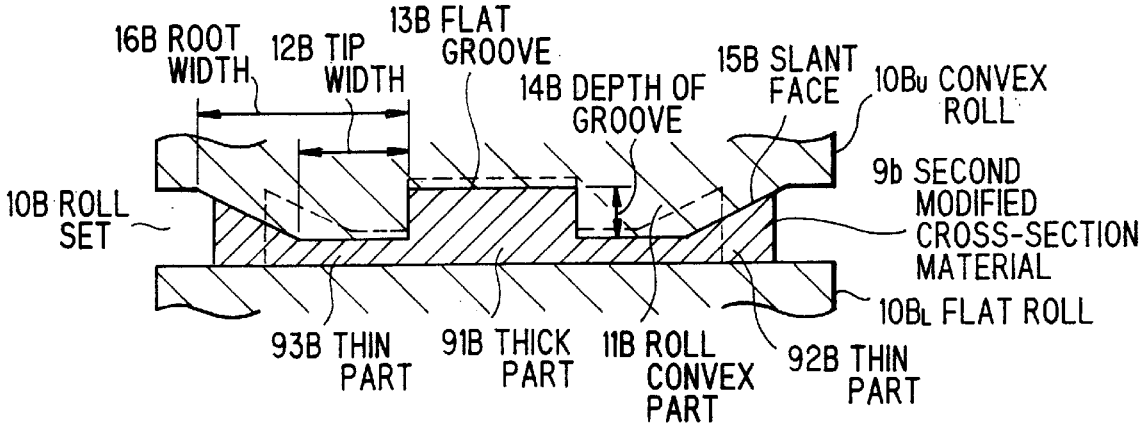
Figure 4C:
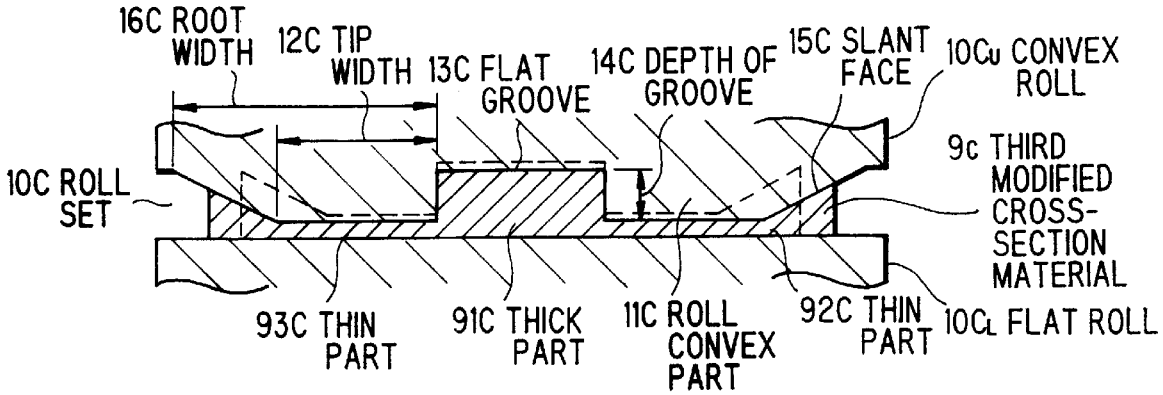

In FIGS. 4A to 4C, each of convex rolls 10Au, 10Bu, 10Cu has a groove 13A, 13B, 13C in the center and a roll convex part 11A, 11B, 11C on the both sides of each groove, respectively. Slant faces, each having the same width, are formed on the outside of the roll convex parts 11A, 11B, 11C, respectively. The tip width 12A of the roll convex part 11A of the convex roll 10Au is small. Then, the tip width 12B of the roll convex part 11B of the convex roll 10Bu is larger than the tip width 12A. Further, the tip width 12C of the roll convex part 11C of the convex roll 10Cu is larger than the tip width 12B. Thus, the root width ("tip width"+ "width of the slant face") 16B of the roll convex part 11B is larger than the root width 16A of the roll convex part 11A, and the root width 16C of the roll convex part 11C is larger than the root width 16B of the roll convex part 11B.

In FIG. 4A, the roll set 10A is a combination of the convex roll 10Au and the flat roll 10AL. The convex roll 10Au has a flat groove 13A for forming a thick part 91A and two roll convex parts 11A for forming thin parts 92A, 93A. A first modified cross-section material 9*a* is rolled to be formed from the flat material 9 by the roll set 10A.

In FIG. 4B, the roll set 10B is a combination of the convex roll 10Bu and the flat roll 10BL. The convex roll 10Bu has a flat groove 13B for forming a thick part 91B and two roll convex parts 11B for forming thin parts 92B, 93B. A second modified cross-section material 9*b* is rolled to be formed from the first modified cross-section material 9*a* by the roll set 10B.

In FIG. 4C, the roll set 10C is a combination of the convex roll 10Cu and the flat roll 10CL. The convex roll 10Cu has a flat groove 13C for forming a thick part 91C and two roll convex parts 11C for forming thin parts 92C, 93C. A third modified cross-section material 9*c* is rolled to be formed from the second modified cross-section material 9*b* by the roll set 10C.

The flat grooves 13A, 13B, 13C are the same in width and depth as each other. Although each tip width of the roll convex parts 11A, 11B, 11C is unequal as shown in FIGS. 4A to 4C, each slant angle of the slant faces 15A, 15B, 15C is equal.

At first, in FIG. 4A, the first modified cross-section material 9*a* is rolled to be formed from the flat material 9 by the roll set 10A. The form of the first modified cross-section material 9*a* is approximately "E" letter type. Then, the first modified cross-section material 9*a* is rolled by the roll set 10B. The second modified cross-section material 9*b* which is wider than the first modified cross-section material 9*a* is formed by expanding the thin parts 92A, 93A in the widthwise direction, because the tip width 12B of the roll convex part 11B is larger than the tip width 12A of the roll convex part 11A. Further, in FIG. 4C, the second modified cross-section material 9*b* is rolled by the roll set 10C. The third modified cross-section material 9*c* which is wider than the second modified cross-section material 9*b* is formed by expanding the thin parts 92B, 93B in the widthwise direction, because the tip width 12C of the roll convex part 11C is larger than the tip width 12B of the roll convex part 11B.

In the above method, while the thin parts are formed by the roll convex parts 11A, 11B, 11C, the thick parts 91A, 91B, 91C can be rolled to be elongated along its length. Thus, the elongation of the thin part can be balanced with the elongation of the thick part. As a result, the modified cross-section material can be manufactured in high productivity, because a waveform and a torsion can be prevented by the balance of the elongations of the thin and thick parts. Further, the rough surface of the thick part can be prevented and the precision of the thick part is to be high, because the surface of the thick part is touched to the roll by rolling the thick part. Therefore, in the present invention, the modified cross-section material with the high quality can be manufactured.

In the above case, when rolling by the roll set 10B, the thin part 93B may be desirably thinner than the thin part 93A formed by the roll set 10A. It is the reason why the decrease of the thickness is occurred in the thin part 93A, which is formed by the roll set 10A, by the elongation occurred by the roll set 10B, then the distribution of the thickness and the condition of the surface may grow worse, when the thickness of the thin part 93B formed by the roll set 10B is equal to or less than that of the thin part 93A formed by the roll set 10A. Further, the prevention of the waveform and the torsion can be more effectively obtained and the stabilized modification can be done, when the modification degree (rolling degree) of the thin part 91B formed by the roll set 10B is larger than that of the thin part 93A formed the roll set 10A. As similar to the relation of the roll sets 10B and 10C, it is necessary to consider the above condition for that of the roll sets 10B and 10C.

In FIG. 3, the number of the rolls can be varied.

As shown in FIG. 4C, when the thick part 91C is positioned between the thin parts 92c, 93C, the modified cross-section material having the thick part in the center continuously is manufactured by the combination of the grooved roll having the groove in the center and the flat roll. In this case, as similar to the roll sets 10A, 10B, it is necessary to consider the above condition. Where the modified cross-section material is annealed at a predetermined temperature, the modification of the thick part is more easy to be equal to that of the thin part. Thus, it is possible to manufacture the modified cross-section material in which the quality of the thick part is equal to that of the thin part.

Although it is desired that the rolling processes are done successively, the material maybe wound at each stage of the rolling processes. Further, the annealing can be done between each two of the rolling processes or only before the final rolling process.

In the first preferred embodiment, the roll convex part may have the slant faces at the both sides thereof. In this case, the inside slant angle of the prior roll convex part may be desirably smaller relative to the horizontal line than that of the next roll convex part. Further, the depth of the prior groove can be deeper than that of the next groove and the width of the prior groove can be larger than that of the next groove.

The slant angle of the prior convex roll can be larger relative to the horizontal line than that of the next convex roll.

Next, a method of manufacturing a modified cross-section material in the second preferred embodiment according to the invention will be explained in FIG. 5.

Figure 5:
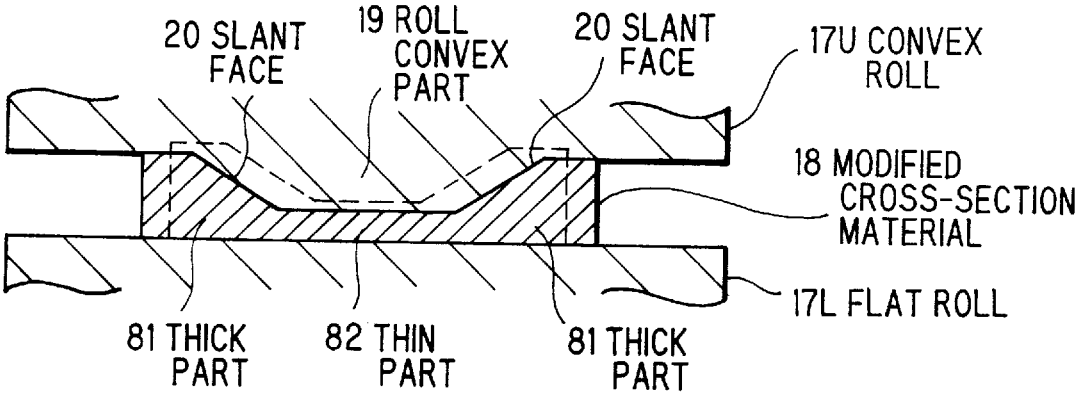
FIG. 5 is a block schematic diagram of a method of manufacturing a modified cross-section material in a second preferred embodiment of the present invention.

In FIG. 5, a manufactured modified cross-section material 18 has a thin part in the center and two thick parts on both sides. It has slant faces between the thick part 81 and the thin part 82. This modified cross-section material is manufactured by a convex roll 17U and a flat roll 17L. The convex roll 17U comprises a roll convex part 19 having the slant faces 20 on the both sides in compliance with the form of the modified cross-section material 18. In this case, the thick part 81 is produced by flat faces formed on outside of the slant faces 20.

In this case, at the time when the thin part 82 is rolled to be formed, the thick parts 81 can be rolled to be elongated in the along lengthwise direction. Thus, the elongation of the thin part 82 can be balanced with the elongation of the thick parts 81. As a result, the modified cross-section material 18 can be manufactured in high productivity, because the occurrence of a waveform and a torsion can be prevented by the balance of the elongations of the thin and thick parts. Further, the quality of the surfaces and the precision of the thick parts 81 are to be high, because the surfaces of the thick parts 81 are touched to the roll. Therefore, in the present invention, the modified cross-section material with the high quality can be manufactured.

In the second preferred embodiment, the slant angle of the next convex roll can be larger relative to the horizontal line than that of the prior convex roll.

Next exemplified dimensions of rolls used in a method of manufacturing a modified cross-section material in the present invention will be listed in FIG. 6. The rolls comprises first to fourth roll sets which are arranged to provide first to fourth rolling stages in tandem with predetermined intervals, wherein each of the first to third roll sets comprises a convex roll and a flat roll, and the fourth roll set comprises a grooved roll and a flat roll. By using the first to fourth roll sets, a modified cross-section material having a thick part in the center is manufactured from a copper flat material having a thickness of 3.5 mm and a width of 60 mm. In FIG. 6, slant angles are indicated relative to the horizontal line.

At the first rolling stage, the thick part is rolled to be 3.07 mm (rolling degree 12.3%) and the thin part is rolled to be 1.02 mm (rolling degree 70.1%). At the second rolling stage, the thick part is rolled to be 2.82 mm (rolling degree 8.1%) and the thin part is rolled to be 0.96 mm (rolling degree 5.9%). In this case, the waveform deformation is not occurred in the thin part, and the rolling process is normally completed. At the third rolling stage, the thick part is rolled to be 2.64 mm (rolling degree 6.7%) and the thin part is rolled to be 0.96 mm (rolling degree 0%). At the forth rolling stage, the thick part is rolled to be 2.14 mm (rolling degree 18.6%) and the thin part is rolled to be 0.81 mm (rolling degree 15.6%). In this case, the waveform deformation is not occurred in the thin part, and the rolling process is normally completed. Thus, the modified cross-section material in which the rough surface of the thick part is suppressed, and the decrease of the thickness is avoided successively formed.

Further, after the rolling processes, the modified cross-section material is annealed by the heat treatment, and it is rolled by a roll set comprising a flat roll and a grooved roll having a groove (its depth is 0.81 mm) in the center, so that the rolling degree of the thick part is to be nearly the same as that of the thin part. Thus, the modified cross-section material which has the thick part of 1.30 mm (rolling degree 39.2%) and the thin part of 0.50 mm (rolling degree 38.3%), in which the quality of the thick part is equal to that of the thin part, can be manufactured.

Therefore, the modified cross-section material can be manufactured in high productivity and improved operability with preventing a waveform deformation and a torsion, because the thick part is rolled to be expanded along its length by parts other than the roll convex part, while the thin part is rolled to be expanded in the widthwise direction by the roll convex part.

Further, the surface of the modified cross-section material can be high quality and the precision of the thick part is to be high, because the surface of the thick part is touched and held by the roll. Therefore, in the present invention, the modified cross-section material with the high quality can be manufactured.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within mites and bounds of the claims, or equivalence of such mites and bounds are therefore intended to embraced by the claims.

In the claims:

1. A method of manufacturing a modified cross-section material having a thin part and a thick part in widthwise direction and the thin part and the thick part extending in a lengthwise direction, comprising the steps of:

providing a plurality of roll sets arranged to provide a plurality of rolling stages in tandem with predetermined intervals, each of said plurality of roll sets comprising a flat roll and a convex roll having a convex part defined by two side faces and a flat tip face, at least one of said two side faces being slant, and said tip face of the convex roll of a rear roll set having a width larger than that of said tip face of the convex roll of a front roll set;

forming said thin part of said modified cross-section material by said convex part of said convex part of said convex roll in accordance with a substantial expansion in the lengthwise direction; and forming said thick part of said modified cross-section material by a part other than said convex part of said convex roll in accordance with a substantial expansion in the lengthwise direction.

2. The method of manufacturing a modified cross-section material according to claim 1, wherein:

the thin part formed by a following roll set is thinner than the thin part formed by a prior roll set.

3. The method of manufacturing a modified cross-section material according to claim 1, wherein:

a rolling degree of said thick part of said modified cross-section member is larger than that of said thin part thereof at a second rolling stage and following rolling stages thereof.

4. The method of manufacturing a modified cross-section material according to claim 1, wherein:

said convex roll has two convex parts and a groove having a predetermined width defined between said two parts; and said thick part is formed in the center of said modified cross-section material by said groove of said convex roll.

5. The method of manufacturing a modified cross-section material according to claim 4, wherein:

a depth of the groove of said convex roll is shallower at a rear rolling stage than that of the groove thereof at a front rolling stage.

6. The method of manufacturing a modified cross-section material according to claim 4, wherein:

a width of the groove of said convex roll is narrower at a rear rolling stage than that of the groove thereof at a front rolling stage.

7. The method of manufacturing a modified cross-section material according to claim 4, wherein:

said two side faces of said convex part of said convex roll are slant, and an angle of one side face of said two faces of said convex part having a rolling contact with said thick part of said modified cross-section material is larger at a rear rolling stage relative to a horizontal line than that of said convex part of a front rolling stage.

8. The method of manufacturing a modified cross-section material according to claim 4, wherein:

said two side faces of said convex part of said convex roll are slant, and an angle of one side face of said two side faces of said convex part having a rolling contact with said thin part of said modified cross-section material is smaller at a rear rolling stage relative to a horizontal line than that of said convex part of a front rolling stage.

9. The method of manufacturing a modified cross-section material according to claim 1, wherein:

said convex roll has a convex part defined by two slant side surfaces and a tip face, whereby said modified cross-section material has a thin part in the center.

10. The method of manufacturing a modified cross-section material according to claim 1, wherein:

the steps of forming said thin and thick parts are successively done through said plurality of said rolling stages.

11. The method of manufacturing a modified cross-section material according claim 1, further comprising the steps of:

annealing said modified cross-section material having said thin and thick parts thus formed at a predetermined temperature;

rolling said annealed material to equalize rolling degrees of said thick and thin parts.

* * * * *